US011020645B2

(12) United States Patent
Connelly

(10) Patent No.: US 11,020,645 B2
(45) Date of Patent: Jun. 1, 2021

(54) RING-SHAPED PUNCHBAG WITH INNER PUNCHBALL

(71) Applicant: Connelly Sports Ltd, Coatbridge (GB)

(72) Inventor: David Joseph Connelly, Hamilton (GB)

(73) Assignee: Connelly Sports Ltd, Hamilton (GB)

( * ) Notice: Subject to any disclaimer, the term of this patent is extended or adjusted under 35 U.S.C. 154(b) by 0 days.

(21) Appl. No.: 16/822,526

(22) Filed: Mar. 18, 2020

(65) Prior Publication Data

US 2020/0298082 A1 Sep. 24, 2020

(30) Foreign Application Priority Data

Mar. 18, 2019 (GB) ..... 1903626

(51) Int. Cl.
*A63B 69/20* (2006.01)

(52) U.S. Cl.
CPC ..... *A63B 69/201* (2013.01); *A63B 69/206* (2013.01)

(58) Field of Classification Search
CPC . A63B 69/201; A63B 69/206; A63B 2225/62; A63B 2244/102; A63B 69/20; A63B 69/203; A63B 69/205
See application file for complete search history.

(56) References Cited

U.S. PATENT DOCUMENTS 582,583 A * 5/1897 Fitzsimmons ..... A63B 69/208 482/90
717,273 A * 12/1902 Reach ..... A63B 69/205 482/87
732,396 A * 6/1903 Cunningham ..... A63B 69/205 482/87
732,740 A * 7/1903 Hansen ..... A63B 69/208 482/90
829,257 A * 8/1906 Cary ..... A63B 69/208 482/90
1,598,865 A * 9/1926 Limerick ..... A63F 9/02 473/595
2,237,599 A * 4/1941 Gilman ..... A63B 69/345 473/444
2,249,309 A * 7/1941 Benko ..... A63B 69/32 73/379.05
2,449,935 A * 9/1948 Gilman ..... A63B 69/345 473/444
2,466,954 A * 4/1949 King ..... A63B 69/345 473/443
2,643,124 A * 6/1953 Malone ..... A63B 69/205 482/87
3,337,217 A * 8/1967 Cummins ..... A63B 69/345 473/442
3,650,530 A * 3/1972 Gantz ..... A63B 63/083 482/90
4,491,315 A * 1/1985 Dye ..... A63B 69/201 473/442

(Continued)

*Primary Examiner* — Garrett K Atkinson

(74) *Attorney, Agent, or Firm* — Alan G. Towner; Leech Tishman Fuscaldo & Lampl

(57) ABSTRACT

Training equipment is described, and in particular training equipment that can be punched for exercise or for training, e.g., by boxers. The training equipment includes an outer ring-shaped punchbag and an inner punchball positioned within an inner opening of the punchbag. The punchball is connected to the punchbag by a pair of flexible elongate members that can be elasticated cords, for example.

7 Claims, 2 Drawing Sheets

(56) References Cited

U.S. PATENT DOCUMENTS 4,527,796 A * 7/1985 Critelli ..... A63B 21/0602 473/442
5,046,724 A * 9/1991 Sotomayer ..... A63B 69/20 482/90
5,330,199 A * 7/1994 Vand ..... A63B 63/004 273/400
5,433,434 A * 7/1995 Helmetsie ..... A63B 63/00 473/446
5,697,872 A * 12/1997 Stronsick, Jr. ..... A63B 69/34 482/83
5,725,458 A 3/1998 Newman et al.
5,800,319 A * 9/1998 Choate ..... A63B 69/34 482/83
5,941,801 A * 8/1999 D'Alto ..... A63B 69/208 482/83
6,244,993 B1 * 6/2001 Dunn ..... A63B 69/201 482/83
6,302,831 B1 * 10/2001 Henry ..... A63B 69/004 482/83
6,432,027 B1 * 8/2002 Haselrig ..... A63B 69/201 482/83
7,244,219 B1 * 7/2007 Preciado ..... A63B 69/24 482/83
7,390,288 B2 * 6/2008 Giaquinta ..... A63B 69/20 482/85
7,658,699 B1 2/2010 Johnson, Jr.
7,678,028 B1 * 3/2010 Gore ..... A63B 69/201 482/89
D675,696 S * 2/2013 Fu ..... D21/798
8,876,671 B1 * 11/2014 Hurtato, Jr. ..... A63B 69/24 482/87
9,504,893 B2 * 11/2016 Nelson ..... A63B 69/20
9,739,576 B1 * 8/2017 Venigalla ..... A63B 63/00
10,132,600 B2 * 11/2018 Saunders ..... F41J 3/0004
10,343,007 B2 * 7/2019 Nelson ..... A63B 21/4043
10,561,920 B2 * 2/2020 Wagner ..... A63B 69/345
10,661,137 B1 * 5/2020 Nicely ..... A63B 69/002
2002/0115538 A1 8/2002 Wen
2007/0087912 A1 * 4/2007 DeCologero ..... A63B 69/201 482/86
2009/0264263 A1 * 10/2009 Yang ..... A63B 69/20 482/85
2009/0264264 A1 10/2009 Reen
2010/0093503 A1 * 4/2010 Commeau ..... A63B 69/201 482/87
2010/0179031 A1 * 7/2010 Luigi ..... A63B 69/201 482/89
2016/0184684 A1 6/2016 Ray
2018/0256957 A1 9/2018 Slechta, Jr.

* cited by examiner

RING-SHAPED PUNCHBAG WITH INNER PUNCHBALL

CROSS-REFERENCE TO RELATED APPLICATION

This application claims the benefit of Great Britain Patent Application Serial No. GB 1903626.8 filed Mar. 18, 2019, which is incorporated herein by reference.

FIELD OF THE INVENTION

The present invention relates to training equipment, and in particular to training equipment that can be punched for exercise or for training, e.g., by boxers.

SUMMARY OF THE INVENTION

The present invention provides training equipment comprising an outer ring-shaped punchbag defining an inner opening, the punchbag having a longitudinal axis; and an inner punchball positioned in the inner opening and connected to the punchbag by at least one flexible elongate member; wherein the punchbag further comprises a first securing location specifically adapted such that the training equipment is suspended in use with the longitudinal axis of the punchbag substantially horizontal.

The ring-shaped punchbag will typically be substantially circular and define a substantially circular inner opening. But it will be understood that it can have any suitable overall shape (e.g., substantially square, rectangular etc.) and any suitable cross-section (e.g., substantially circular, square, rectangular etc).

The punchbag may comprise an outer layer of material (often leather or similar) that is filled with a suitable filler. In some cases, the punchbag may comprise an outer layer of a harder or more semi-rigid material that is filled with a suitable filler or left hollow.

The punchball is preferably suspended within the inner opening by the at least one flexible elongate member and is preferably spaced apart from the punchbag, e.g., by an annular gap or void.

The punchball is preferably connected to the punchbag at a second securing location by a first flexible elongate member and at a third securing location by a second flexible elongate member. The second and third securing locations may be on an inner surface of the punchbag defining the periphery of the inner opening. The second and third securing locations may be substantially diametrically opposed across the inner opening. The punchball may have corresponding first and second securing locations to which the first and second flexible elongate members are respectively connected. The first and second securing locations on the punchball may be substantially diametrically opposed on the outer surface of the punchball or at opposite ends of the punchball, for example.

The punchball may be similar in design and construction to a so-called "floor to ceiling" or "double end" ball and may be used for timing practice and to improve hand eye coordination. The punchball may be substantially round, egg-shaped or dumbbell-shaped, for example, and may comprise an outer layer of material (often also leather or similar) that is either filled with a suitable filler or an inflatable bladder.

The first and second flexible elongate members (e.g., cords or straps) that are used to connect the punchball to the punchbag may be elasticated to permit the punchball to undergo erratic movement backwards and forwards within the inner opening of the punchbag when punched. In one arrangement, the flexible elongate members may be "bungee cords" or shock cords comprising one or more elastic strands, or similar. In another arrangement, the flexible elongate members are not elasticated.

The first securing location is specifically adapted to allow the training equipment to be suspended in use, preferably by means of a third flexible elongate member (e.g., a cord, strap, or chain). The training equipment may be suspended from a ceiling or from a training frame, for example.

DETAILED DESCRIPTION

Figure 1:
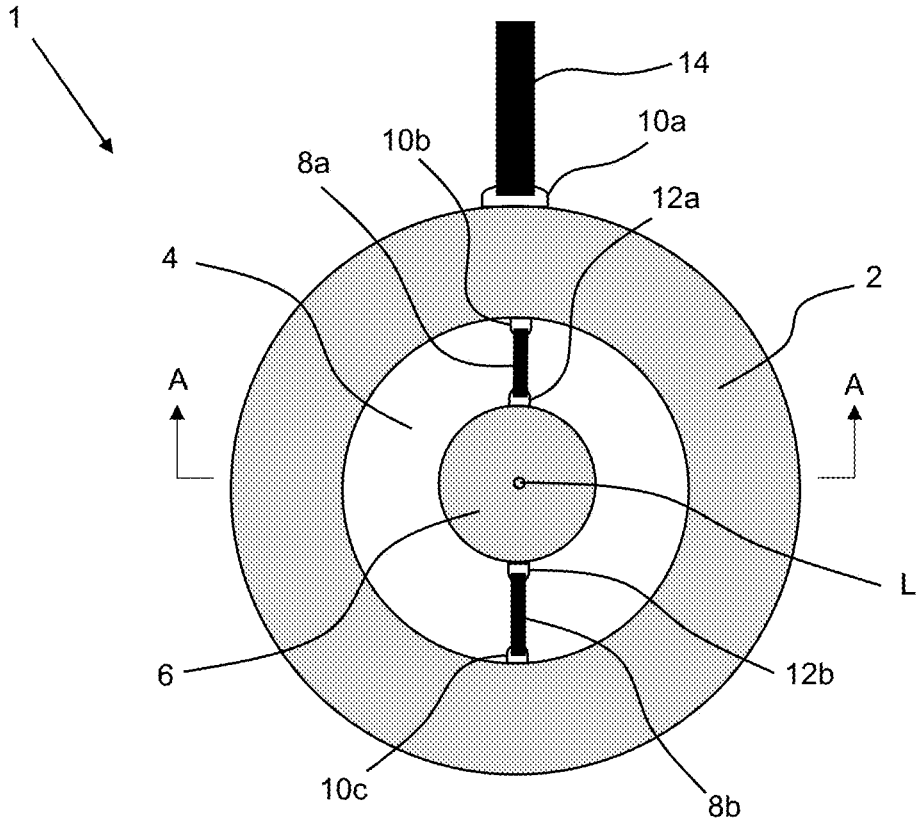
FIG. 1 is a front view of training equipment according to the present invention.
Figure 2:
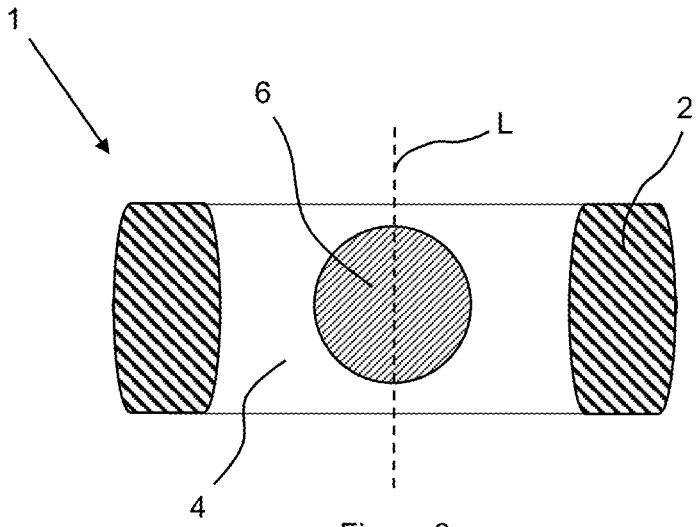
FIG. 2 is a cross-section view of the training equipment of FIG. 1 along line A-A.
Figure 3:
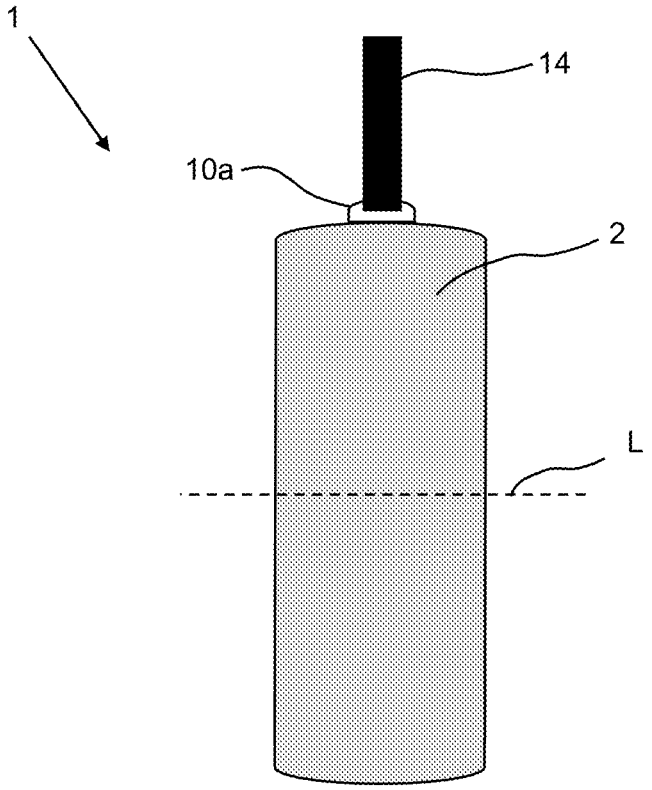
FIG. 3 is a side view of the training equipment of FIG. 1.

With reference to FIGS. 1 to 3, an item of training equipment 1 according to the present invention includes an outer ring-shaped punchbag 2. The punchbag 2 has a substantially rectangular cross-section (see FIG. 2) and a substantially circular overall shape when viewed from the front (see FIG. 1). The punchbag 2 defines a substantially circular inner opening 4. It will be readily appreciated that the punchbag can have other cross-sections (e.g., substantially circular), other overall shapes, and can define an inner opening that is not substantially circular. The punchbag 4 comprises an outer layer of material that is filled with a suitable filler. The punchbag may also be hollow.

An inner punchball 6 is positioned in the inner opening 4 of the punchbag 2. It will be readily appreciated that although the punchball 6 shown in FIGS. 1 and 2 is round, it can have any suitable shape, e.g., it can be egg-shaped or dumbbell-shaped. The punchball 6 comprises an outer layer of material that is either filled with a suitable filler or an inflatable bladder.

The punchbag 2 comprises a first securing location 10*a* that allows the training equipment 1 to be suspended in use by a cord, strap or chain 14. The training equipment 1 may be suspended from a ceiling or from a training frame, for example. The first securing location 10*a* is adapted such that the training equipment 1 is suspended in use with the longitudinal axis L of the punchbag 2 substantially horizontal. The longitudinal axis L represents the line passing through the centroid of the cross-section of the punchbag 2 or the training equipment as a whole, for example.

The punchball 6 is connected to the punchbag 2 by two elasticated cords 8*a*, 8*b* such that it is suspended freely within the inner opening 6 and is spaced apart from the punchbag 2 as shown. A first elasticated cord 8*a* extends between a second securing location 10*b* on the punchbag 2 and a first securing location 12*a* on the punchball 6. Similarly, a second elasticated cord 8*b* extends between a third securing location 10*c* on the punchbag 2 and a second securing location 12*b* on the punchball 6. The second and third securing locations 10*b*, 10*c* on the punchbag 2 are substantially diametrically opposed across the inner opening 4. The elasticated cords 8*a*, 8*b* permit the punchball 6 to undergo erratic movement within the inner opening 4 when punched by the boxer or trainer to improve timing and hand eye coordination. The boxer or trainer can use the outer punchbag 2 in much the same way as a "conventional" cylindrical punchbag.

Whereas particular embodiments of this invention have been described above for purposes of illustration, it will be evident to those skilled in the art that numerous variations of the details of the present invention may be made without departing from the invention as defined in the appended claims.

The invention claimed is:

1. Training equipment comprising:

an outer ring-shaped punchbag defining an inner opening, the punchbag having a longitudinal axis; and an inner punchball positioned in the inner opening and connected to the punchbag by at least one flexible elongate member;

wherein the punchbag further comprises a first securing location specifically adapted such that the training equipment is suspended in use with the longitudinal axis of the punchbag substantially horizontal.

2. The training equipment according to claim 1, wherein the inner opening is substantially circular.

3. The training equipment according to claim 1, wherein the punchbag is spaced apart from the punchball by an annular gap.

4. The training equipment according to claim 1, wherein the punchball is connected to the punchbag at a second securing location by a first flexible elongate member and at a third securing location by a second flexible elongate member.

5. The training equipment according to claim 4, wherein the second and third securing locations are substantially diametrically opposed across the inner opening.

6. The training equipment according to claim 4, wherein the first and second flexible elongate members are elasticated.

7. The training equipment according to claim 1, wherein the at least one flexible elongate member is elasticated.

* * * * *